US006378575B1

(12) United States Patent
Marchau

(10) Patent No.: US 6,378,575 B1
(45) Date of Patent: Apr. 30, 2002

(54) METHOD FOR CONTROLLING THE FILLING OF CONTAINERS WITH A FLOWABLE PRODUCT AND FILLING INSTALLATION IMPLEMENTING SAID METHOD

(75) Inventor: Bernard Marchau, Quimper (FR)

(73) Assignee: Remy Equipment, Dreux (FR)

( * ) Notice: Subject to any disclaimer, the term of this patent is extended or adjusted under 35 U.S.C. 154(b) by 0 days.

(21) Appl. No.: 09/807,582

(22) PCT Filed: Oct. 13, 1999

(86) PCT No.: PCT/FR99/02475

§ 371 Date: Apr. 16, 2001

§ 102(e) Date: Apr. 16, 2001

(87) PCT Pub. No.: WO00/23373

PCT Pub. Date: Apr. 27, 2000

(30) Foreign Application Priority Data

Oct. 16, 1998 (FR) ..... 98 13008

(51) Int. Cl.[7] ..... B65B 1/04

(52) U.S. Cl. ..... 141/234; 141/238; 141/83; 141/94

(58) Field of Search ..... 141/234, 237, 141/238, 242, 243, 83, 94, 192, 198

(56) References Cited

U.S. PATENT DOCUMENTS 6,044,876 A * 4/2000 Ally et al. ..... 141/130

FOREIGN PATENT DOCUMENTS

| | | |
|---|---|---|
| DE | 43 41 934 | 6/1995 |
| EP | 0 082 990 | 7/1983 |
| EP | 0 086 098 | 8/1983 |
| EP | 0 641 714 | 3/1995 |
| EP | 0 691 303 | 1/1996 |
| WO | 90 05666 | 5/1990 |

* cited by examiner

*Primary Examiner*—Steven O. Douglas
(74) *Attorney, Agent, or Firm*—Sughrue Mion, PLLC

(57) ABSTRACT

A method and an installation for controlling the filling of containers (5) with a flowable product in a filling installation has a product reservoir (1) and a filling unit (3) for simultaneously filling several containers (5). The method consists in: measuring the total real flow rate of product delivered by the filing unit (3) to the whole set of containers (5); detecting the number n of containers (5) being filled in the filling unit (3); displaying a theoretical flow rate q of the individual filling of the containers (5); comparing the total real flow rate measured and the theoretical flow rate n.q; and, correcting, if necessary, the total real flow rate to make it coincide with the theoretical flow rate. The operation of the installation is thereby adapted to the exact number of containers being actually filled simultaneously, with no significant variations of real individual filling flow rates.

7 Claims, 1 Drawing Sheet

METHOD FOR CONTROLLING THE FILLING OF CONTAINERS WITH A FLOWABLE PRODUCT AND FILLING INSTALLATION IMPLEMENTING SAID METHOD

The present invention relates to the field of filling containers with a flowing product in a filling installation comprising a product reservoir and a filling unit enabling several containers to be filled simultaneously.

The problem underlying the technique of filling containers is to deliver a predetermined quantity (by volume, by weight, . . . ) of flowing product to each container within the shortest time (in other words, at the highest filling rate or at the highest flow rate) and to do so regardless of the actual capacity of the container and/or its geometric and dimensional characteristics and/or the rheological characteristics of the product being packaged.

These requirements give rise to a number of difficulties, particularly in installations where moving containers are filled continuously one after the other (in-line filling systems).

A first difficulty relates to the need to regulate rapidly and finely the flow rate supplied by each filling nozzle: it is, of course, possible to intervene manually in a filling plant under normal conditions but this has to be ruled out in certain types of installation (filling installations in a sterile environment in which any manual intervention would require the system to be shut down and a full decontamination cycle run before starting the system up again).

Another difficulty resides in the high loss of pressure which varies depending on the number of filling nozzles in operation at any one time (the nozzles are in principle supplied by force of gravity from a tank with a constant level). In particular, these pressure losses vary during phases when the installation is being started up or shut down as and when filling nozzles come into service, generally accompanied by variations in the flow rates at nozzles already in operation.

Furthermore, if an installation is operating continuously, an incident may occur in supplying one or more containers (a container is missing or incorrectly positioned underneath the nozzle). Depending on the technological layout of the installation, either the corresponding nozzle delivers the product, which is then lost (product wastage) or the nozzle is suppressed which modifies the flow rate of the other nozzles.

There is currently a demand for a remotely operated method (i.e. without manual intervention in the system) of positively and instantaneously controlling the effective individual flow rates of all the filling nozzles in the plant and such a control system needs to be easy to operate, as inexpensive as possible and undemanding in terms of maintenance.

To these ends, one of the first aspects proposed by the invention is a method of controlling the filling of containers with a flowing product within a filling system comprising a product reservoir and a filling unit, enabling several containers to be filled simultaneously, said method, configured as proposed by the invention, being characterised in that: the total real flow rate of the product delivered by

- the filling unit to all the containers is measured, the theoretical number n of containers being filled within the filling unit is detected,
- a theoretical individual filling rate of the containers q is displayed,
- the measured total real flow rate and the theoretical flow rate n·q are compared and
- if necessary, the real total flow rate is corrected to bring it into line with the theoretical flow rate, as a result of which, operation of the filling installation can be adapted to the number of containers being filled simultaneously without any significant variations in the real individual filling rates.

Implementing the method enables the desired requirements to be met, since the flow rates are managed fully automatically and no manual intervention is required in the installation: application of this method would be of particular interest for filling installations in a sterile environment.

Furthermore, regulation can be operated very quickly and the skilled person in particular would have no difficulty in setting up electronic means to work in real time. As a result, it would be perfectly feasible to apply the method proposed by the invention to an in-line filling installation, even if operated at a high rate, in order to manage the process of filling individual containers at an optimum flow rate, including transition phases (start-up, shut-down) of the installation and during continuous operation, in particular to deal with any faults in the supply to the containers (container missing or incorrectly positioned underneath (the-nozzle).

As a second aspect, the invention proposes an installation for filling containers with a flowing product, comprising a product reservoir and a filling unit fitted with a plurality of filling nozzles enabling several containers to be filled simultaneously, said installation, configured as proposed by the invention, being characterised in that it comprises:

- a proportionally controllable valve, incorporated in the supply line between the filling unit and the product reservoir,
- means for measuring the total real flow rate of the product effectively circulating in the filling unit,
- sensor means designed to determine the number n of containers being filled within the filling unit,
- means for displaying the theoretic individual filling rate q of the containers,
- computing means for determining the global theoretical flow rate n·q of the product to be supplied to the filling unit, and
- comparator means receiving and comparing the data pertaining to the total real flow rate measured by the measuring means and the theoretical flow rate computed by the computing means, said comparator means having a control output connected to a control for the valve regulating the product flow supplied to the filling unit.

Throughout the description, any valve which can be regulated on a proportional basis will be referred to as a proportional valve.

In one possible embodiment, the means for measuring the total real flow rate of the product comprise a flow meter for measuring relatively high flow rates, disposed in series with the main proportional valve and, for measuring relatively low flow rates, a circuit bypassing the main proportional valve having a flow meter for measuring low flow rates and a secondary proportional valve, the main valve and the secondary valve being selectively brought into service depending on the flow rate to be measured.

In another possible embodiment, the means for measuring the real flow rate of the product comprise a plurality of individual flow meters co-operating respectively with the filling nozzles and summing means to determine the sum $\Sigma qi$ of the individual flow rates qi detected.

The means proposed by the invention are preferably applied in an installation in which the filling unit is set up as a rotating carousel with filling nozzles distributed around the periphery, the containers being filled on a predetermined angular sector of the circular path followed by the nozzles, and more specifically may be applied in such an installation designed to fill containers in a sterile environment.

The invention will be more readily understood from the detailed description of certain embodiments below, given by way of illustration only and not restrictive in any respect, and with reference to the appended drawings, of which:

Figure 1:
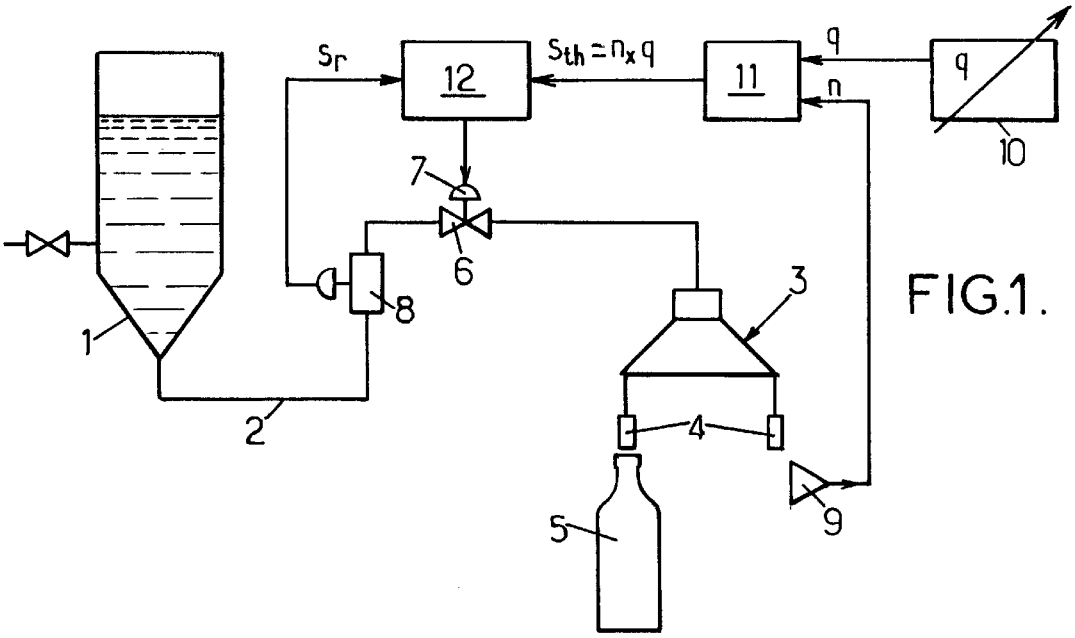
FIG. 1 is a diagram illustrating the layout of a first embodiment of an installation as proposed by the invention.

Turning firstly to FIG. 1, the flowing product (generally a liquid) is delivered to a tank 1 where a device known per se (not illustrated) keeps the product at a constant level.

A drawing-off pipe 2 delivers the flowing product to a filling unit 3 which, in practice, is an in-line filling unit of the rotating carousel type or a similar type.

The filling unit 3 is fitted with a plurality of filling nozzles 4 having means of support (by the neck and/or by the base) for containers 5.

The general layout of such an installation does not fall within the scope of the present invention: it may be of any layout of any type suited to the relevant function and desired performance.

In accordance with the invention, a proportional shut-off valve 6 is provided in the pipe 2, operated by a proportional control member 7. This control system may be of any type (pneumatic, hydraulic, mechanical, . . . ) but in this case is preferably electrical, due to the operating means used for the purposes of the invention, which will be explained below.

The principle on which operation of the filling unit 3 is controlled by means of the proportional valve 6 consists in measuring and comparing the instantaneous real flow rate of the product delivered to the filling unit 3 on the one hand and the instantaneous theoretical rate at which the filling unit 3 should be supplied on the other, and determining, on the basis of this comparison, a control signal for the valve, which regulates the instantaneous total real flow rate delivered to the filling unit 3 in order to bring it into line with the instantaneous theoretical flow rate.

To this end, a flow meter 8 is also fitted on the line 2, which supplies an electric signal $S_r$ representing the instantaneous total real flow rate of the product flowing through the pipe 2 and delivered to the filling unit 3.

Means 9 are provided in the filling unit 3 for detecting the number n of containers being filled.

A device 10 displays the theoretical value of the flow q which should be delivered to each container.

A multiplier device 11 receiving the electric signals representing the values n and q works out the product n×q constituting the signal $S_{th}$ representative of the instantaneous theoretical flow rate which should be supplied to the filling unit 3.

The two signals $S_r$ and $S_{th}$ are then compared in a comparator device 12, which applies a control signal $S_r-S_{th}$ to its output, intended for the control member 7 in order to actuate the valve under conditions such that the instantaneous total real flow rate matches the instantaneous theoretical flow rate.

The electronic devices commercially available these days (microprocessors) have the requisite data processing capacity and speed to run the functions described above so as to obtain the desired regulation in real time.

Figure 2:
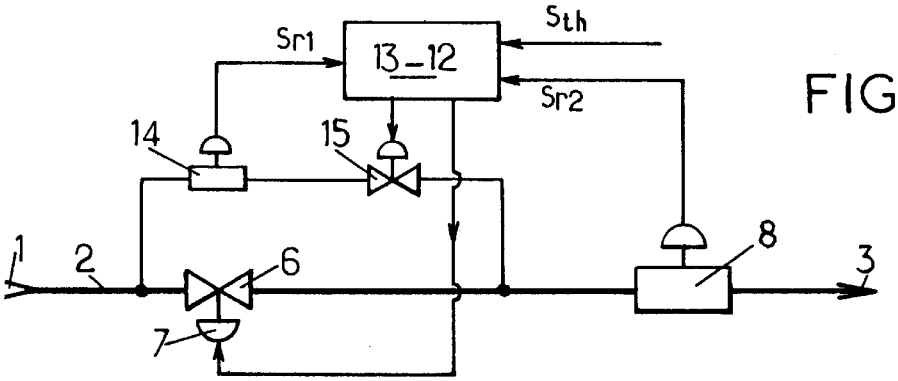
FIG. 2 is a diagram of another embodiment of a part of the installation illustrated in FIG. 1.

Since the flow meters may have operating ranges which do not permit them to cover both high flow rate measurements and low flow rate measurements, it would be conceivable to opt for a layout of the type illustrated in FIG. 2 as a means of extending the operating range of the installation illustrated in FIG. 1.

The flow meter 8 suitable for measuring high flow rates is disposed in the pipe 2 and in series with the main proportional valve 6. By-passing the main valve 6, a flow meter 14 suitable for measuring low flow rates is connected in series with a secondary proportional valve 15. A processor 13, co-operating with the comparator 12, selectively opens and closes valves 6 and 15 depending on the level of flow detected and selects the appropriate signal from the two signals $S_{r1}$ supplied by the flow meter 14 and $S_{r2}$ supplied by the flow meter 18 so as to be able to regulate as desired whichever valve 6 or 15 is in service.

Figure 3:
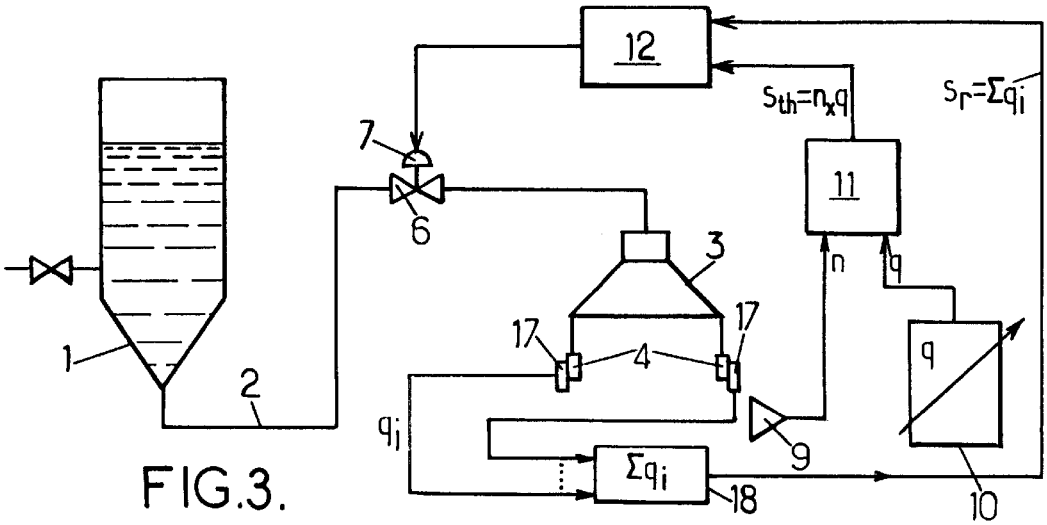
FIG. 3 is a diagram showing the layout of another embodiment of an installation as proposed by the invention.

In another embodiment illustrated in FIG. 3, each filling nozzle 4 is fitted with an individual flow meter 17. The data $q_i$ measured by these flow meters are summed in a summing device 18 which issues a signal $S_r=\Sigma q_i$ representing the instantaneous total real flow rate delivered by the filling unit 3. The installation is otherwise of the same layout as that described above in relation to FIG. 1.

What is claimed is:

1. Method of controlling the filling of containers (5) with a flow product in a filling installation comprising a product reservoir (1) and a filling unit (3) enabling several containers (5) to be filled simultaneously, characterised in that:

the total real flow rate of product delivered by the filling unit (3) to all the containers (5) is measured, the number n of containers (5) being filled within the filling unit (3) is detected, a theoretical individual filling rate q for the containers (5) is displayed, the measured total real flow rate and the theoretical flow rate n.q are compared and if necessary, the total real flow rate is corrected to bring it into line with the theoretical rate, as a result of which, operation of the filling installation can be adapted to the exact number of containers effectively being filled simultaneously, without any significant variations in the real individual filling rates.

2. Installation for filling containers with a flowing product comprising a product reservoir (1) an a filling unit (3) fitted with a plurality of filling nozzles (4) enabling several containers (5) to be filled simultaneously, characterised in that it comprises:

a proportionately adjustable valve (6) inserted in the supply line (2) between the product reservoir (1) and the filling unit (3), means for measuring (8; 14; 17, 18) the total real flow rate of the product effectively circulating in the filling unit (3), sensor means (9) suitable for determining the number n of containers being filled within the filling unit (3), means (10) for displaying the theoretical individual filling rate q of the containers (5), computing means (11) for determining the global theoretical flow rate n.q of the product to be delivered to the filling unit (3) and comparator means (12) receiving and comparing the total real flow rate data measured by the computing means, said comparator means having a control output connected to a control (7) for the valve (6) for proportionally regulating the product flow rate delivered to the filling unit (3).

3. Installation as claimed in claim 2, characterised in that the means for measuring the total real flow rate of the product comprise a flow meter (8) disposed in the pipe (2) conveying the product from the reservoir (1) to the filling unit (3).

4. Installation as claimed in claim 2, characterised in that in order to cover measuring of flow rates in a wider range, the means for measuring the total real product flow rate comprise a flow meter (8) for measuring relatively high flow rates which is disposed in series with the main proportional valve (6) and, in order to measure relatively low flow rates, a circuit bypassing the main proportional valve and comprising a flow meter (14) for measuring low flow rates and a secondary proportional valve (15), control means being provided in order to bring the main valve and the secondary valve selectively into service depending on the flow rate to be measured.

5. Installation as claimed in claim 2, characterised in that the means for measuring the total real product flow rate comprise a plurality of individual flow meters (17) co-operating respectively with the filling nozzles (4) and summing means (18) determining the sum $\Sigma qi$ of the individual flow rates qi detected.

6. Installation as claimed in claim 2, characterised in that the filling unit (3) is set up in the form of a rotating carousel with the filling nozzels (4) distributed around the periphery, the containers (5) being filled on a predetermined angular sector of the circular path followed by the nozzles.

7. Installation as claimed in claim 2, characterised in that it is configured to enable containers to be filed in a sterile environment.

* * * * *